US007909652B2

(12) United States Patent
Yang et al.

(10) Patent No.: US 7,909,652 B2
(45) Date of Patent: Mar. 22, 2011

(54) ELECTRICAL CONNECTOR WITH TWO GROOVES DIVIDING CONTACTS

(75) Inventors: Sheng-Ho Yang, Tu-Cheng (TW); Tsu-Yang Wu, Tu-Cheng (TW); Bin Pan, Iriven, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/539,564

(22) Filed: Aug. 11, 2009

(65) Prior Publication Data

US 2010/0035478 A1 Feb. 11, 2010

(30) Foreign Application Priority Data

Aug. 11, 2008 (TW) ..... 97214369 U

(51) Int. Cl.
*H01R 24/00* (2006.01)

(52) U.S. Cl. ..... 439/660

(58) Field of Classification Search ..... 439/660, 439/638, 540.1

See application file for complete search history.

(56) References Cited

U.S. PATENT DOCUMENTS

| | | | | |
|---|---|---|---|---|
| 6,832,934 | B1 * | 12/2004 | Zhang | 439/660 |
| 7,497,709 | B1 * | 3/2009 | Zhang | 439/188 |
| 2008/0188136 | A1 * | 8/2008 | Su et al. | 439/660 |
| 2009/0068896 | A1 * | 3/2009 | Zhang | 439/626 |
| 2010/0099307 | A1 * | 4/2010 | Zhang et al. | 439/660 |
| 2010/0105249 | A1 * | 4/2010 | Bandhu et al. | 439/638 |

* cited by examiner

*Primary Examiner* — Chandrika Prasad

(74) *Attorney, Agent, or Firm* — Wei Te Chung; Andrew C. Cheng; Ming Chieh Chang

(57) ABSTRACT

An electrical connector (2, 3) provides an interface compatible with an internal micro Serial ATA connector. The electrical connector (2, 3) includes an insulated housing (21, 31), a first number of contacts (221, 222, 223, 321, 322, 323) assembled to the insulated housing (21, 31); and a second number of contacts (224, 225, 324, 325) assembled to the insulated housing (21, 31). The first number of contacts (221, 222, 223, 321, 322, 323) constitute a power segment and a signal segment compatible with the internal micro Serial ATA connector. The second number of contacts (224, 225, 324, 325) is used for mating with a new type of mating connector (3, 2) when higher transfer speed is needed.

12 Claims, 5 Drawing Sheets

ELECTRICAL CONNECTOR WITH TWO GROOVES DIVIDING CONTACTS

CROSS-REFERENCE TO RELATED APPLICATIONS

The subject matter disclosed herein is related to the subject matter disclosed in pending U.S. patent application Ser. No. 12/288,143, filed on Oct. 16, 2008 and entitled "ELECTRICAL CONNECTORS FOR STORAGE DEVICE", which is assigned to the same assignee as this application.

BACKGROUND OF THE INVENTION

1. Field of the Invention

The present invention generally relates to an electrical connector, and more particularly to an electrical connector providing an interface for a storage device.

2. Description of Related Art

The Serial ATA International Organization published a proposed Serial ATA draft specification of revision 0.70 on 21 Sep. 2006. The Serial ATA draft specification disclosed an internal micro Serial ATA plug connector (hereinafter the Micro SATA plug) and an internal micro Serial ATA backplane connector (hereinafter the Micro SATA backplane) for mating with the Micro SATA plug in Pages 101-109.

The micro SATA plug has a signal segment and a power segment sharing a common base. The signal segment has a tongue portion extending from the common base for mating into the micro SATA backplane and seven signal contacts disposed in one side face of the tongue portion for delivering signals. The power segment has a tongue portion extending from the common base for mating into the micro SATA backplane and nine power contacts disposed in one side face of the tongue portion for delivering powers. The tongue portions of the signal segment and the power segment are coplanar and the contacts of the signal segment and the power segment are disposed on the same side of the tongue portions.

The micro SATA backplane has a signal segment and a power segment for mating with the signal segment and the power segment of the micro SATA plug. The signal segment and the power segment share a common insulated housing. The signal segment defines a slot in the housing for receiving the tongue portion of the signal segment of the micro SATA plug. The signal segment has seven signal contacts disposed in one inner side face of the slot for delivering signals. The power segment defines another slot in the housing besides the slot of the power segment for receiving the tongue portion of the power segment of the micro SATA plug. The power segment has nine power contacts (two of them are optional MFG pins) disposed in one inner side face of the slot for delivering powers.

However, the market demands new interfaces to increase the transfer speed of the micro SATA specification and compatible with the micro SATA plug and incompatible with micro SATA backplane.

SUMMARY OF THE INVENTION

Accordingly, an object of the present invention is to provide electrical connectors providing interfaces compatible with internal micro Serial ATA connectors with higher transfer speed comparing the internal micro Serial ATA specification.

In order to achieve the object set fourth, an electrical connector providing interfaces compatible with internal micro Serial ATA connectors comprising an insulated housing, a first plurality of contacts assembled to the insulated housing and a second plurality of contacts assembled to the insulated housing. The first plurality of contacts constitute a power segment and a signal segment compatible with the internal micro Serial ATA connector. The second plurality of contacts are used for mating with a new type of mating connector when higher transfer speed is needed.

In order to achieve the object set fourth, an electrical connector assembly for connecting a storage device, comprising a first electrical connector and a second electrical connector is disclosed. The first electrical connector comprises a first insulated housing defining a longitudinal slot in a front face, the slot defining a first and a second inner side faces facing to each other, and the first and second inner side faces extending in a first direction perpendicular to the front face; a first plurality of contacts disposed in the first insulated housing and aligned along the first side face, the first plurality of contacts being compatible with an internal micro Serial ATA plug connector; and a second plurality of contacts disposed in the first insulated housing and aligned along the second inner side face. The second mating electrical connector comprises a second insulated housing having a base portion and an longitudinal tongue portion extending from a front face of the base portion along the first direction for mating into the slot of the first insulated housing, the tongue portion defining a first outer side face parallel to the first direction and a second outer side face opposite to the first side face; a first plurality of contacts assembled to the second insulated housing and aligned along the first outer side face for mating with the first plurality of contacts of the first electrical connector; and a second plurality of contacts assembled to the second insulated housing and aligned along the second outer side face for mating with the second plurality of contacts of the first electrical connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
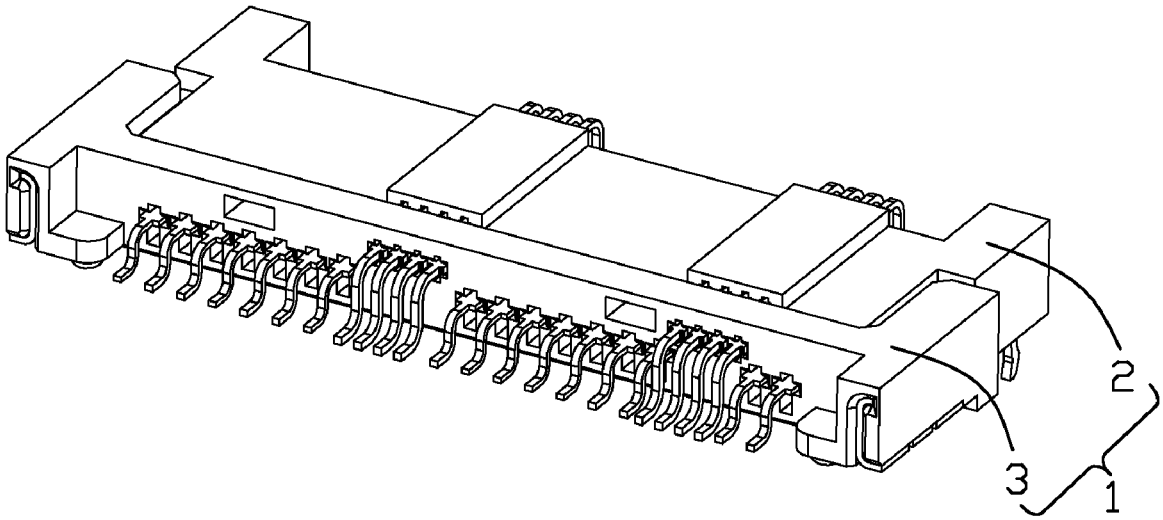
FIG. 1 is a perspective view of an electrical connector assembly in accordance with the present invention.
Figure 2:
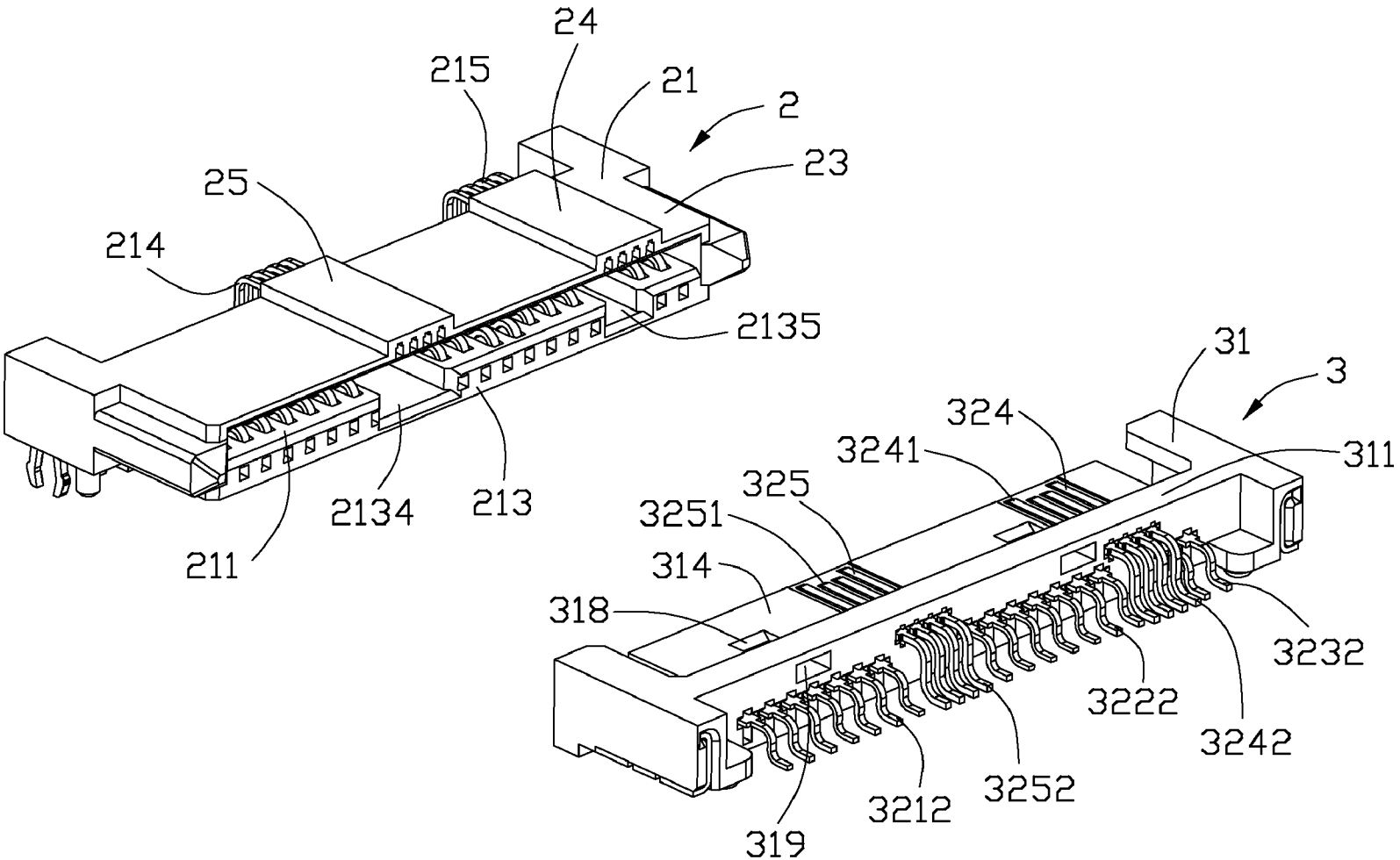
FIG. 2 is a view similar to FIG. 1, except that the first electrical connector and the second electrical connector are unmated.
Figure 3:
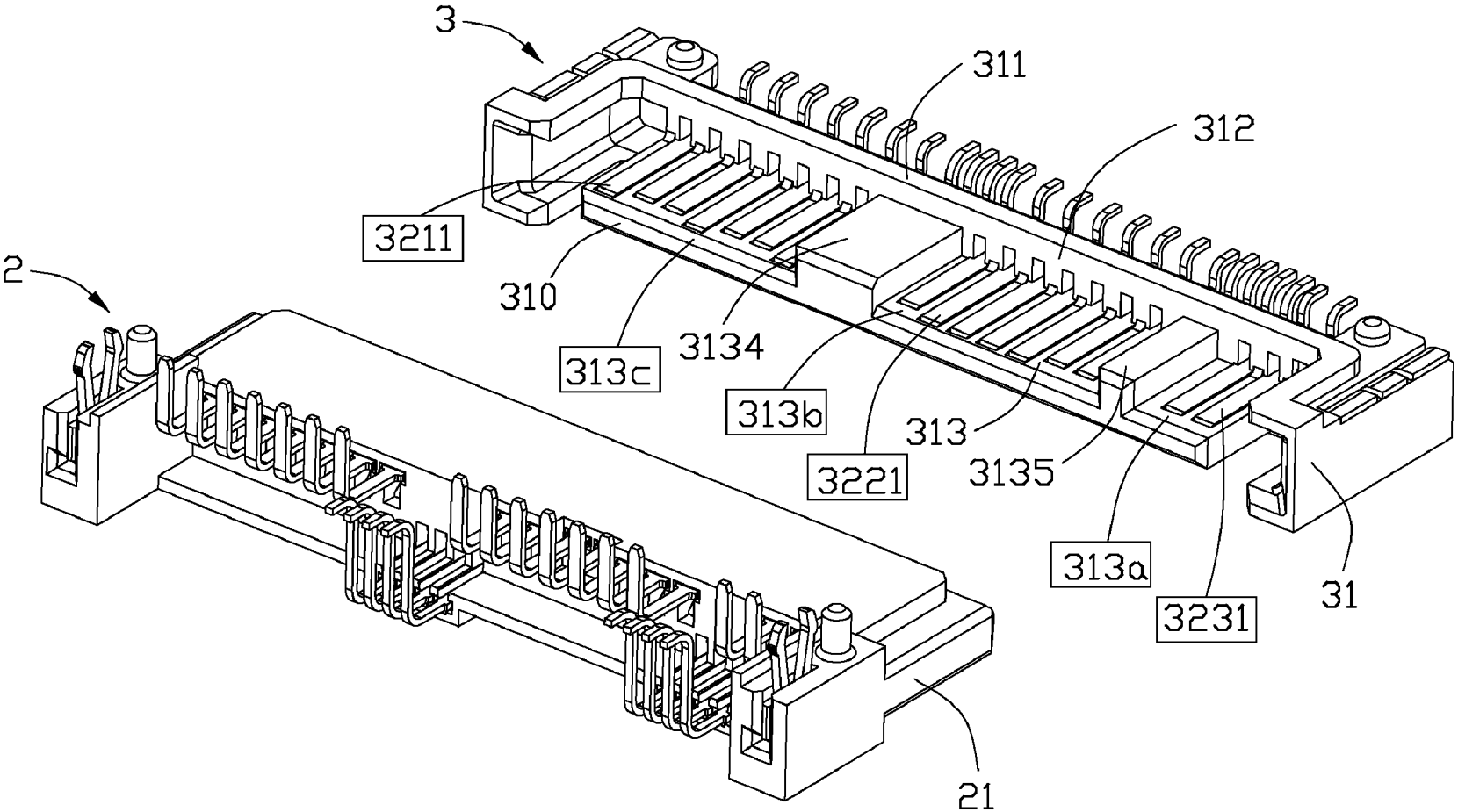
FIG. 3 is a view similar to FIG. 2, but viewed from a different aspect.

Referring to FIGS. 1-3, an electrical connector assembly 1 according to the present invention is shown. The electrical assembly 1 includes a first electrical connector 2 to be mounted on a first circuit board (not shown) and a second electrical connector 3 mounted on a second circuit board (not shown). The electrical connectors 100, 200 are used for providing interfaces for a storage device.

Figure 4:
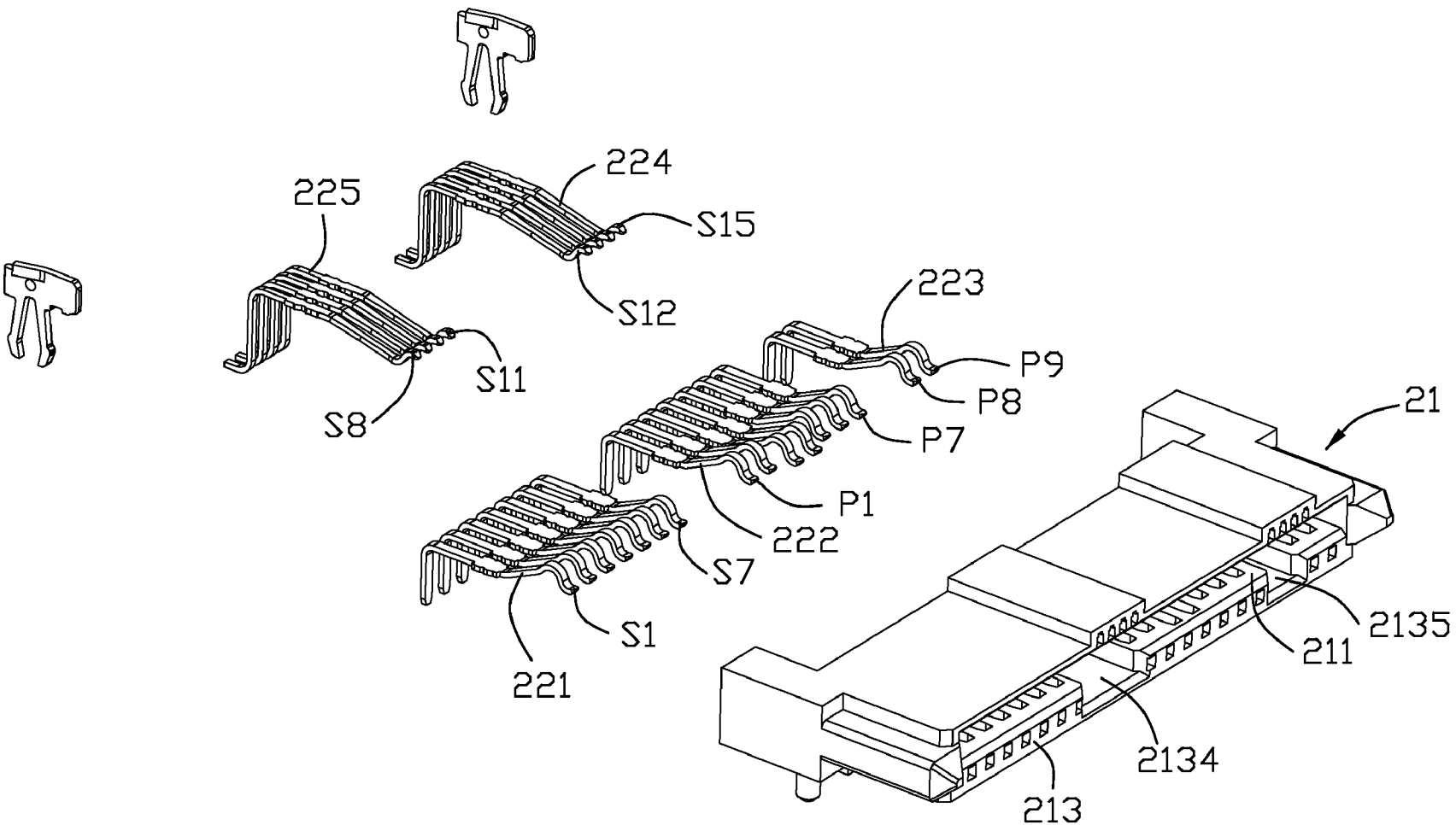
FIG. 4 is an exploded view of the first electrical connector.

Referring to FIGS. 2-4, the first electrical connector 2 comprises a first insulated housing 21 defining a front face 213 and a first plurality of contacts S1-S7, P1-P9 assembled to the first insulated housing 21. The first insulated housing 21 defines a longitudinal slot 211 in the front face 213, the slot 211 having a first and a second inner side faces (not labeled) facing to each other, and the first and second inner side faces extending in a first direction perpendicular to the front face 213. The first plurality of contacts S1-S7, P1-P9 are aligned along the first side face, each of said contacts S1-S7, P1-P9 extending along the first direction for mating with the second electrical connector 3. The first inner side face of said slot 211 further defines two grooves 2134, 2135 extending along the first direction from the front face 213, said two grooves 2134, 2135 dividing the plurality of contacts S1-S7, P1-P9 into three groups 221, 222, 223. The three groups of contacts 221, 222, 223 are respectively named, in sequence, a third, a second and a first groups.

The slot 211 and the grooves 2134, 2135 are shaped compatible with an internal micro Serial ATA plug connector and the grooves prevents insertion of other Serial ATA cables. The first group of contacts 223 composes of two optional contacts P8, P9 for delivering power; the second group of contacts 222 composes of seven contacts P1-P7 for delivering power; the third group of contacts 221 composes of seven contacts S1-S7 for delivering signal, wherein the optional contacts P8, P9 are not used in some times, therefore a power segment and a signal segment are form within the first electrical connector 2.

The first electrical connector 2 further comprises a second plurality of contacts S8-S15 assembled to the first insulated housing 21 and aligned along the second side face, each of said second plurality of contacts S8-S15 extending along the first direction for mating with the second electrical connector 3. The second plurality of contacts compose of eight contacts S8-S15 and are divided into two groups, the fourth group 224, and the fifth group 225. The fourth group of the contacts 224 is aligned to the groove 2135 between the first group of contacts 223 and the second group of contacts 222 in a second direction perpendicular to the second side face. The fifth group of the contacts 225 is aligned to the groove 2134 between the second group of contacts 222 and the third group of contacts 221 in the second direction.

The outer side surface 24 opposite to the second inner side face of the first insulting housing defines two spaced expanding portions 24, 25. The expanding portions 24, 25 extend perpendicularly to the front face and face to grooves 2135, 2134 respectively. The forth group and the fifth group are loaded in the expanding portions respectively. The forth group 224 of the second contacts face to the first group 223 of first contacts and a neighboring groove 2135 of said two grooves in a direction perpendicular to the second side face of the insulated housing simultaneously. The fifth group 225 of the second contacts faces to the other groove 2134 of said two grooves in the direction.

Figure 5:
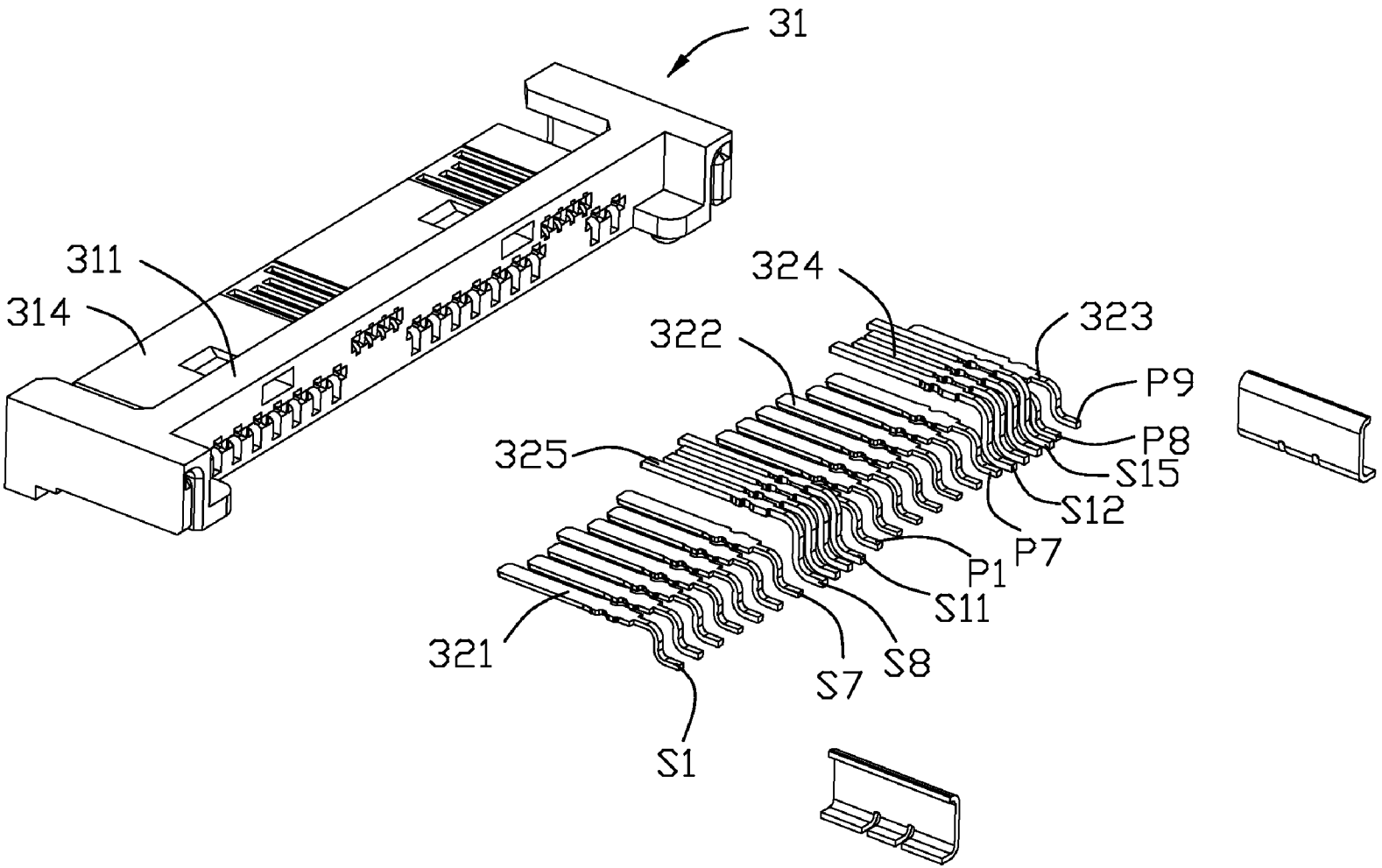
FIG. 5 is an exploded view of the second electrical connector.

Referring to FIGS. 2, 3 and 5, the second electrical connector 3 in accordance with the present invention is shown. The second electrical connector 3 comprises a second insulated housing 31 and a first plurality of contacts S1-S7, P1-P9 assembled to the second insulated housing 31. The insulated housing 31 has a base portion 311 defining a front face 312 and an integral tongue portion 310 extending from the front face 312 along a first direction, the integral tongue portion 310 defining a first outer side face 313 parallel to the first direction and a second outer side face 314 opposite to the first side face 313. The first plurality of contacts S1-S7, P1-P9 are aligned along the first outer side face 313, each of said contacts S1-S7, P1-P9 extending along the first direction for respectively contacting the contacts S1-S7, P1-P9 of the first electrical connector 2. The integral tongue portion 310 forms two ribs 3134, 3135 on the first side face 313 of the integral tongue portion 310. The two ribs 3134, 3135 extend along the first direction from the front face 312 of the base portion 311 and divide the first plurality of contacts S1-S7, P1-P9 into three groups. The three groups of contacts S1-S7, P1-P9 are respectively named, in sequence, a first, a second and a third groups.

The second electrical connector 3 forms a power segment 262 having two groups of the contacts P1-P9 and a signal segment having one group of the contacts S1-S7. The contacts P1-P9, S11-S7 of power segment and the signal segment could be compatible with an internal micro Serial ATA backplane connector except that the rib 3134 prevents insertion of the electrical connector 3 into the internal micro Serial ATA backplane connector. The first group of contacts 323 composes of two optional contacts P8, P9 used for delivering power, wherein the optional contacts P8, P9 are not used in some times. The second group of contacts 322 composes of seven contacts P1-P7 used for delivering power. The third group of contacts 321 composes of seven contacts S1-S7 being used for delivering signal.

The second electrical connector 3 further comprises a second plurality of contacts 324, 325 shown in FIGS. 2, 3 and 5. The second plurality of contacts S8-S15 are aligned along the second outer side face 314, each of the second plurality of contacts S8-S15 extending along the first direction for mating with the first electrical connector 2. The second plurality of contacts compose of a fourth group of contacts 325 and a fifth group of contacts 325. The fourth group of contacts 325 comprises of four contacts S12-S15 and is aligned to the rib 3135 between the first group of contacts 323 and the second group of contacts 322. The fourth group of contacts 324 comprises of four contacts S8-S11 and is aligned to the rib 3134 between the second group of contacts 322 and the third group of contacts 321. Each of the first and the second pluralities of contact forms a soldering portion 328.

Said two ribs on the first side face divide said first face to three spaced different contact areas 313*a*, 313*b*, 313*c*. The second plurality of contacts comprises first contacting sections 3231, 3221, 3211 positioned upon said three contact areas of first face in turn and first tail sections 3232, 3222, 3212 exposing to a rear face of the elongated base. The second plurality of contacts disposed in the housing with second contacting sections 3241, 3251 positioned upon the second face around said first and second ribs to form two spaced contact regions and second tail sections 3242, 3252 exposing to the rear face of the elongated base. The alignments of the fourth and the fifth groups of contacts 324, 325 with the ribs 3134, 3135 make that the tail portions 3222-3252 of the contacts 321-325 can be arranged in a line. The second face is further equipped with two recesses 318 which rearwardly communicates with an exterior via a through hole 319 which extends therethrough the base, the recesses 318 respectively are disposed at one side of contact regions of the group of second contacts. The first and second expanding portions 24 & 25 are deemed as group members of a first group and the first and second grooves 2135 & 2134 are deemed as group members of a second group under condition that the group members in one of said first group and said second group having a same dimension along the longitudinal direction while those in the other of said first group and said second group having different dimensions along the longitudinal direction so as to form an asymmetrical manner between the first and second expanding portions 24 & 25 and the first and second grooves 2135 & 2134.

So it could be drawn from the above description that the first electrical connector 2 is compatible with the second electrical connector 3 and the internal micro Serial ATA plug connector, while the second electrical connector 3 is incompatible with the internal micro Serial ATA backplane connector. In addition, the first and the second electrical connectors 2,3 add a secondary port at the internal micro Serial ATA connectors to increase the transfer speed.

It is to be understood, however, that even though numerous characteristics and advantages of the present invention have been set fourth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector assembly comprising:

an insulative housing including an elongated base defining a lengthwise direction thereof and having a unitary mating tongue extending forwardly therefrom, said mating tongue including opposite first and second mating faces thereof;

first and second alignment ribs formed on the first face and spaced from each other along said lengthwise direction to divide said first face into three spaced different contact areas;

a group of first contacts disposed in the housing with first contacting sections positioned upon said three contact areas of first face and first tail sections exposing to a rear face of the elongated base; and a group of second contacts disposed in the housing with second contacting sections positioned upon the second face around back sides of said first and second ribs to form two spaced contact regions and second tail sections exposing to the rear face of the elongated base; wherein said second face is further equipped with two recesses each of which rearwardly communicates with an exterior via a through hole which extends therethrough the base, the recesses respectively are disposed at one side of contact regions of the group of second contacts.

2. The electrical connector as described in claim 1, wherein the first and second alignment ribs are dimensioned to different from each other along said longwise direction while said two spaced contact regions are essentially equal to each other in said lengthwise direction under condition that a pitch of the contacting sections of said first contacts is larger than that of the second contacts.

3. An electrical connector providing an interface for storage device, comprising:

an insulated housing defining an uninterrupted longitudinal slot in a lengthwise direction and through a front face in a lateral direction perpendicular to the lengthwise direction, the slot having a first and a second inner side faces facing to each other, the first inner side face defining two spaced grooves extending perpendicularly and through the front face;

a plurality of first contacts disposed lined along the first inner side face and divided to a first group, a second group and a third group by the grooves;

a plurality of second contacts disposed lined along the second inner side face;

wherein the insulated housing defines two spaced expanding portions on an outer side face opposite to the second inner side face thereof, the expanding portions extend perpendicularly to the front face and are aligned with the grooves in a height direction perpendicular to the length direction and the lateral direction, the plurality of second contacts is divided to a forth group and a fifth group which are loaded in the expanding portions respectively.

4. The electrical connector as described in claim 3, wherein the forth group of the second contacts face to the first group of first contacts and a neighboring groove of said two grooves in the height direction.

5. The electrical connector as described in claim 4, wherein the fifth group of the second contacts face to the other groove of said two grooves in the in the height direction.

6. The electrical connector as described in claim 5, wherein the insulated housing defines a rear face opposite to the front face, said contacts comprise contacting portions exposing in the uninterrupted slot and the tail portions exposing to the rear face to be soldered on a printed circuit board.

7. The electrical connector as described in claim 6, wherein said two grooves are used for preventing insertion of other Serial ATA connectors, the first group of the first contacts consists of two optional contacts belonging to a power segment, the second group of the first contacts consists of seven contacts belonging to a power segment, the third group of first contacts consists of seven contacts belonging to a signal segment.

8. The electrical connector as described in claim 7, wherein the fourth group of the second contacts consists of four contacts and the fifth group of the second contacts consists of four contacts.

9. An electrical connector assembly comprising:

an insulative housing including an elongated base defining along a lengthwise direction a longitudinal slot confined by a pair of opposite first and second longitudinal side walls and a pair of opposite first and second end walls linked at two opposite ends of said pair of longitudinal side walls and extending in a lateral direction perpendicular to said longitudinal direction;

a first set of contacts disposed in the first longitudinal side wall;

a second set of contacts disposed in the second longitudinal side wall;

first and second alignment grooves formed in an inner side face of the first longitudinal side wall and spaced from each other in said longitudinal direction so as to divide said first set of contacts with three separate contact regions in said longitudinal direction;

first and second expanding portions formed on an outer face of the second longitudinal side wall and spaced from each other in said longitudinal direction so as to receive said second set of contacts therein, respectively, and divide said second set of contacts with two separate contact areas in said longitudinal direction; wherein the first and second expanding portions are essentially aligned with the corresponding first and second grooves, respectively, in the lateral direction; wherein the first and second expanding portions are deemed as group members of a first group and the first and second grooves are deemed as group members of a second group under condition that the group members in one of said first group and said second group having a same dimension along the longitudinal direction while those in the other of said first group and said second group having different dimensions along the longitudinal direction so as to form an asymmetrical manner between the first and second expanding portions and the first and second grooves.

10. The electrical connector assembly as described in claim 9, wherein the first and second expanding portions have the same dimensions in the longitudinal direction while the first and second grooves have the different dimensions in the longitudinal direction.

11. The electrical connector assembly as described in claim 10, wherein the second set of contacts are divided into two groups with a same amount, respectively received in the corresponding first and second expanding portions having the same dimension in the longitudinal direction.

12. The electrical connector assembly as described in claim 11, wherein the first set of contacts are divided with three groups respectively located on the three contact regions under condition that two of said three contact regions have a same amount of the corresponding contacts thereof and said two of the three contact regions are spaced from each other in the longitudinal direction via one corresponding alignment groove.

* * * * *